US009113713B2

(12) United States Patent
Lin

(10) Patent No.: US 9,113,713 B2
(45) Date of Patent: Aug. 25, 2015

(54) CHAIR

(71) Applicant: Chang-Chen Lin, Tainan (TW)

(72) Inventor: Chang-Chen Lin, Tainan (TW)

( * ) Notice: Subject to any disclaimer, the term of this patent is extended or adjusted under 35 U.S.C. 154(b) by 172 days.

(21) Appl. No.: 14/081,174

(22) Filed: Nov. 15, 2013

(65) Prior Publication Data

US 2015/0035322 A1 Feb. 5, 2015

(51) Int. Cl.

| | |
|---|---|
| ***A47C 1/035*** | (2006.01) |
| ***A47C 1/0355*** | (2013.01) |
| ***A47C 1/032*** | (2006.01) |

(52) U.S. Cl.

CPC ..... *A47C 1/035* (2013.01); *A47C 1/032* (2013.01); *A47C 1/0352* (2013.01); *A47C 1/0355* (2013.01); *A47C 1/03255* (2013.01); *A47C 1/03261* (2013.01); *A47C 1/03294* (2013.01)

(58) Field of Classification Search

CPC ..... A47C 1/035; A47C 1/0355; A47C 1/032; A47C 1/0352; A47C 1/03255

USPC ..... 297/84, 316, 317

See application file for complete search history.

(56) References Cited

U.S. PATENT DOCUMENTS

| | | | | |
|---|---|---|---|---|
| 5,082,324 | A * | 1/1992 | Harada et al. | 297/83 |
| 5,868,461 | A * | 2/1999 | Brotherston | 297/84 |
| 2010/0117423 | A1* | 5/2010 | Lin | 297/316 |

* cited by examiner

*Primary Examiner* — Anthony D Barfield

(57) ABSTRACT

A chair includes a base having a guiding rod. A connecting frame is mounted to a backrest and is pivotably connected to the base. A seat includes a rear end pivotably connected to the connecting frame. An operative frame includes a rear end pivotably connected to the connecting frame. A sliding sleeve is mounted on a front end of the operative frame and is mounted around the guiding rod. At least one supporting plate includes a first end pivotably connected to the front end of the operative frame and a second end pivotably connected to a front end of the seat. When the backrest is moved backward, the connecting frame is actuated to move the operative frame and the seat forward, and the at least one supporting plate is moved to an extended position to move the front end of the seat upward.

8 Claims, 10 Drawing Sheets

CHAIR

BACKGROUND OF THE INVENTION

The present invention relates to a chair and, more particularly, to a chair including a backrest for supporting most weight of a body of a user when the user moves from a sitting posture to a lying posture, providing lying comfort and enhanced supporting stability.

Conventional chairs generally include a reclining device to increase sitting comfort. FIG. 9 shows a conventional chair including a base 1', a seat 2', and a backrest 3'. An armrest 11' is mounted to an upper portion of each of two sides of the base 1'. A guiding rod 12' is mounted to a central portion of each side of the base 1'. A sliding sleeve 21' is mounted on each guiding rod 12' and located in front of the base 1'. The seat 2' includes a pivotal portion 22' at a rear thereof. The backrest 3' includes a lower end having a pivotal portion 31' pivotably connected to the pivotal portion 22' of the seat 2'. The backrest 3' further includes another pivotal portion 32' pivotably connected to a rear end of each armrest 11'. Thus, an angle between the backrest 3' and the seat 2' is small when the chair is in a substantially upright position. The backrest 3' can be moved to a reclining position while moving the seat 2' forward. Each sliding sleeve 21' can be moved to a front end of a corresponding guiding rod 12'. As a result, the angle between the backrest 3' and the seat 2' in the reclining position is larger than the angle in the substantially upright position.

However, an inclination angle θ1 of the seat 2' in the reclining position is small such that most weight of a user lying in the chair is supported by the seat 2', failing to provide lying comfort.

FIG. 10 shows another conventional chair including a base 4', a seat 5', and a backrest 6'. A legrest 51' is provided on a front end of the seat 5'. A spring 52' is attached between the seat 5' and the base 4'. The backrest 6' is at a fixed angle to the seat 5' and includes a pivotal portion 61' pivotably connected to the base 4'. When a user lies down against the backrest 6', the backrest 6' and the seat 5' pivot at the pivotal portion 61' and stretch the spring 52' to restrain the reclining position of the backrest 6'. An inclination angle θ2 of the seat 5' relative to the ground can largely be increased such that most weight of the user is imparted to the backrest 6', providing an effect similar to weightless turn while providing enhanced lying comfort.

However, the center of gravity is shifted to a position behind the base 4' when the seat 5' pivots backward together with the backrest 6', leading to risks of falling of the whole chair due to an unstable center of gravity. Furthermore, the inclination angle θ2 of the seat 5' is larger than that of an average user lying flat, causing discomfort to the user.

BRIEF SUMMARY OF THE INVENTION

An objective of the present invention is to provide a chair including a backrest for supporting most weight of a body of a user when the user moves from a sitting posture to a lying posture, providing lying comfort. Furthermore, a seat of the chair moves forward when the backrest moves backward to provide enhanced supporting stability.

A chair according to the present invention includes a base having a first pivotal portion on an upper portion thereof. The base further includes a guiding rod in front of the first pivotal portion. A connecting frame is mounted to a backrest and includes a second pivotal portion pivotably connected to the first pivotal portion of the base. A seat includes a rear end pivotably connected to the connecting frame. An operative frame includes a rear end pivotably connected to the connecting frame. A sliding sleeve is mounted on a front end of the operative frame and mounted around the guiding rod. At least one supporting plate includes a first end pivotably connected to the front end of the operative frame and a second end pivotably connected to a front end of the seat.

When the backrest is not moved backward, the sliding sleeve is located on a rear end of the guiding rod, and the at least one supporting plate is not in an extended position.

When the backrest is moved backward, the connecting frame is actuated to move the operative frame and the seat forward, the at least one supporting plate is moved to the extended position, and the front end of the seat is moved upward by the at least one supporting plate in the extended position.

Preferably, a column extends upright from each of left and right sides of the base. The first pivotal portion and the guiding rod are provided on each column of the base, with the guiding rod located below the first pivotal portion. Each of two sides of the connecting frame includes a third pivotal portion and a fourth pivotal portion below the third pivotal portion. Each of two sides of the seat includes a rear end having a fifth pivotal portion pivotably connected to the third pivotal portion of one of the sides of the connecting frame. Each side of the seat further includes a sixth pivotal portion located in front of the fifth pivotal portion. Each of two sides of the operative frame includes a rear end having a seventh pivotal portion pivotably connected to the fourth pivotal portion of one of the sides of the connecting frame. Each side of the operative member further includes a front end having an eighth pivotal portion and the sliding sleeve. The at least one supporting plate includes two supporting plates. Each supporting plate includes a first end having a ninth pivotal portion and a second end having a tenth pivotal portion. The ninth pivotal portion of each supporting plate is pivotably connected to the eighth pivotal portion of one of the sides of the operative member. The tenth pivotal portion of each supporting plate is pivotably connected to the sixth pivotal portion of one of the sides of the seat.

The chair as claimed in claim 2, further comprising: a legrest and a link, with the connecting frame further including a lower pivotal portion, with each of the two sides of the seat further including a front end having a front pivotal portion, with the legrest mounted to the front ends of the two sides of the seat, with the legrest including a side having a rear pivotal portion, with the rear pivotal portion pivotably connected to the front pivotal portion of the seat, with the legrest further including an eleventh pivotal portion, with the link including a rear end pivotably connected to the lower pivotal portion of the connecting frame and a front end pivotably connected to the eleventh pivotal portion of the legrest.

Preferably, each side of the seat includes a coupling member behind the sixth pivotal portion. An elastic element is attached between the coupling member of each side of the seat and the ninth pivotal portion of one of the supporting plates.

In an example, the base includes a lower portion having a twelfth pivotal portion pivotably connected to a first end of a telescopic rod. The front end of the seat includes a fourteenth pivotal portion pivotably connected to a second end of the telescopic rod.

Preferably, the backrest includes a first peg on each of two sides thereof and a second peg on a lower end thereof. Each side of the connecting frame includes a first peg hole pivotably receiving one of the first pegs of the backrest. The connecting frame is mounted in front of the lower end of the backrest. The connecting frame further includes a lower portion having a second peg hole pivotably receiving the second peg of the backrest.

Preferably, the lower portion of the connecting frame includes the lower pivotal portion. The sides of the connecting frame are two aims extending from two ends of the lower portion of the connecting frame.

Preferably, the operative frame includes a connecting rod extending between an intermediate portion of one of the sides of the operative frame and an intermediate portion of the other side of the operative frame.

The present invention will become clearer in light of the following detailed description of illustrative embodiments of this invention described in connection with the drawings.

DETAILED DESCRIPTION OF THE INVENTION

Figure 1:
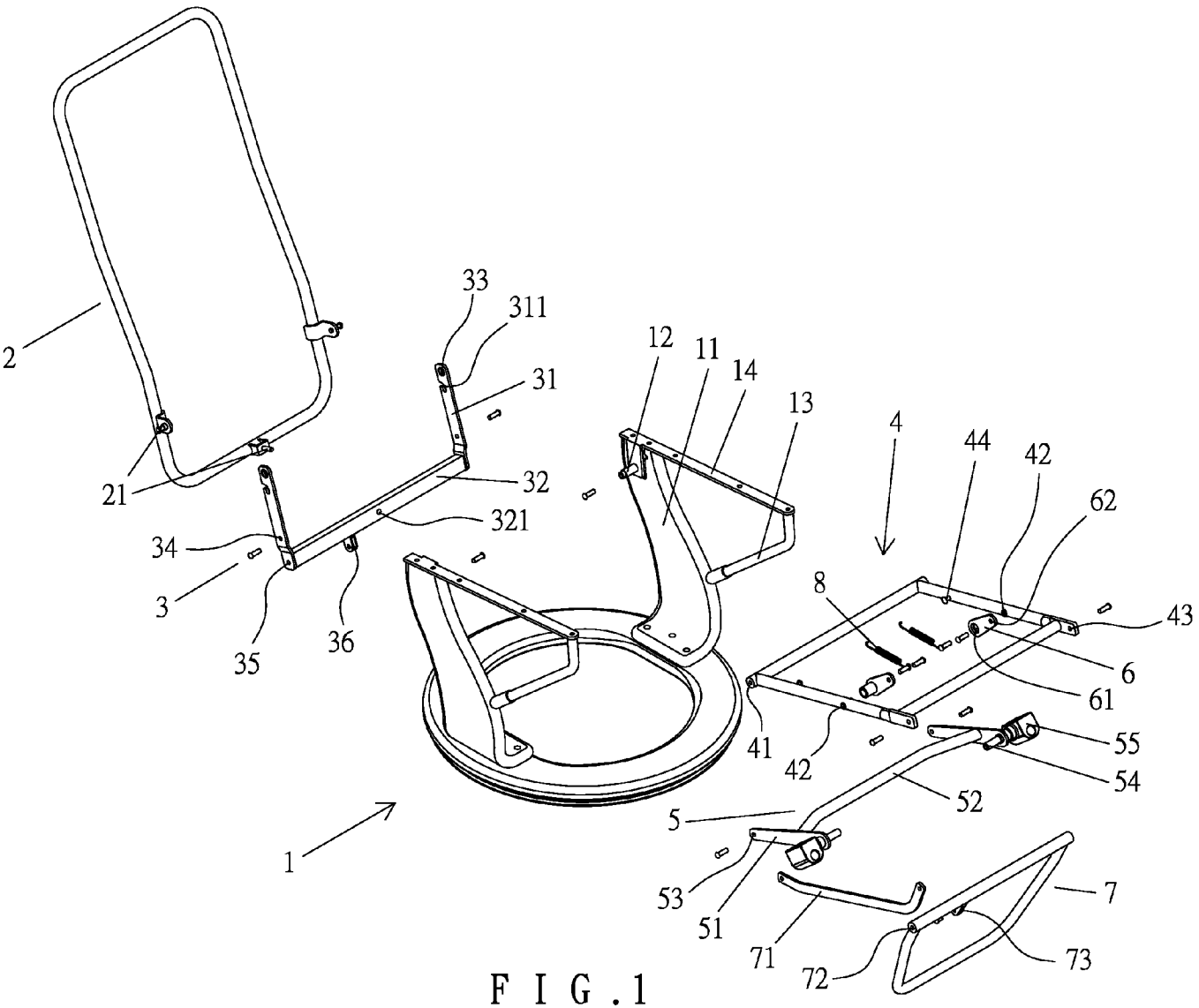
FIG. 1 is an exploded, perspective view of a chair of a first example according to the present invention.
Figure 2:
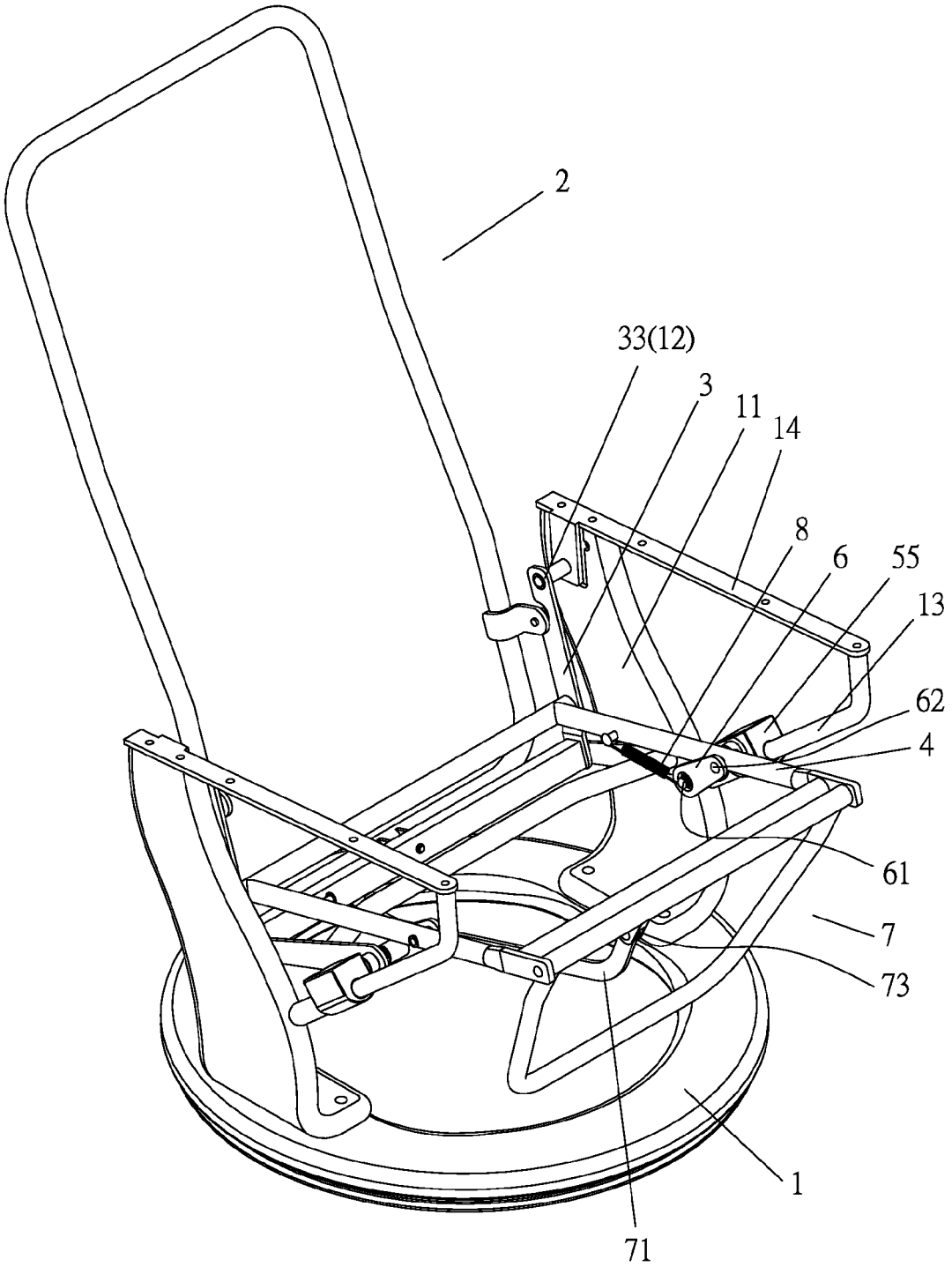
FIG. 2 is a perspective view of the chair of FIG. 1, with the chair in a substantially upright position.
Figure 3:
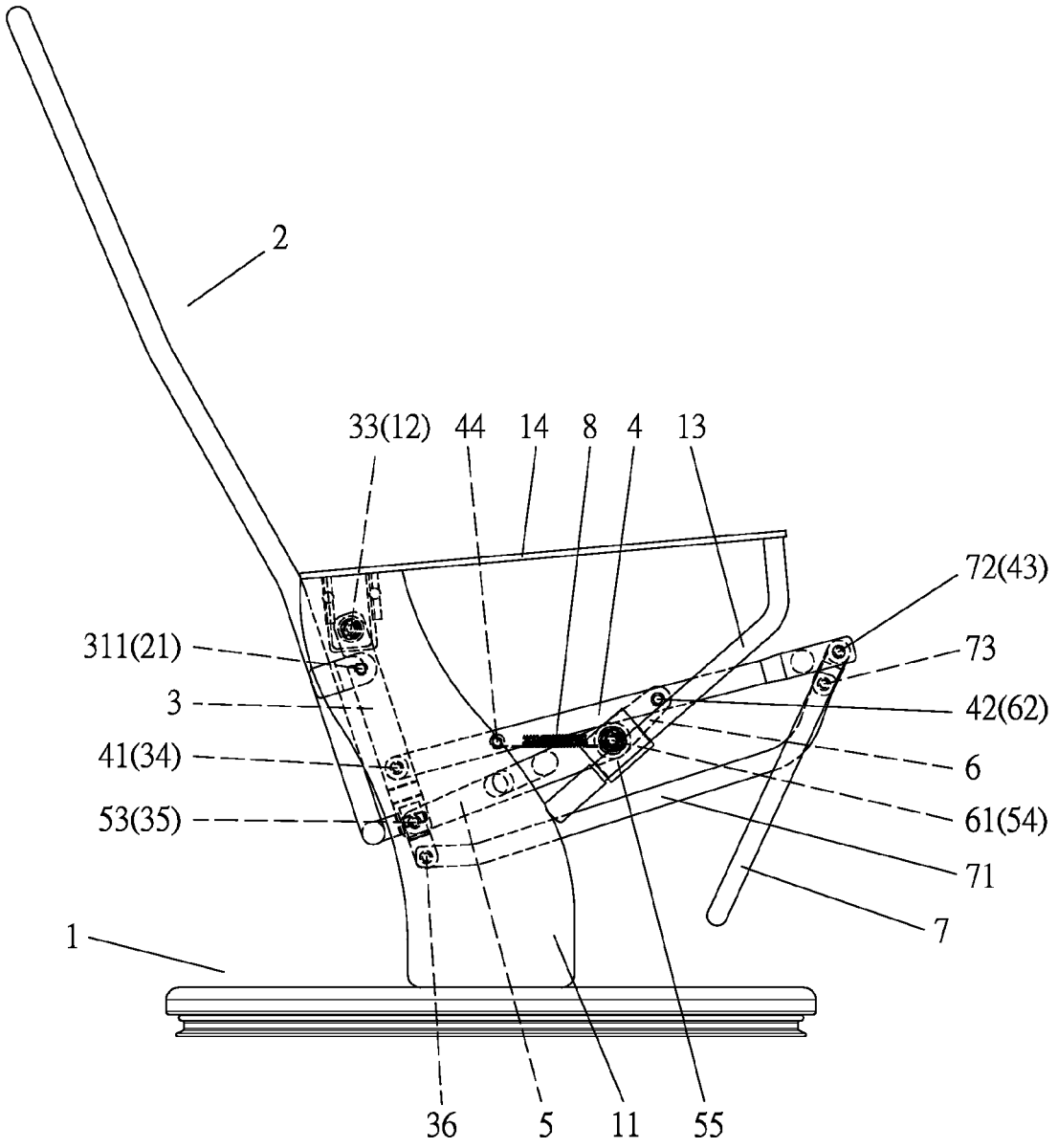
FIG. 3 is a side view of the chair of FIG. 2, with the chair in the substantially upright position.

With reference to FIGS. 1-3, a chair of a first embodiment according to the present invention includes a base 1, a backrest 2, a connecting frame 3, a seat 4, an operative frame 5, two supporting plates 6, a legrest 7, and two elastic elements 8. The base 1 includes a column 11 extending upright from each of left and right sides of the base 1. A first pivotal portion 12 is provided on an upper portion of each column 11. A guiding rod 13 is provided on each column 11 and located in front of and substantially below the first pivotal portion 12. An armrest 14 is mounted on top of each column 11 and is connected to a front end of the guiding rod 13 on the column 11.

The backrest 2 includes a first peg 21 on each of two sides thereof and a second peg 21 on a lower end thereof.

The connecting frame 3 is mounted in front of the lower end of the backrest 2 and includes two sides 31. Each side 31 of the connecting frame 3 includes a first peg hole 311 pivotably receiving one of the first pegs 21 of the backrest 2. The connecting frame 3 further includes a lower portion 32 having a second peg hole 321 pivotably receiving the second peg 21 of the backrest 2. Each side 31 of the connecting frame 3 further includes a second pivotal portion 33 pivotably connected to one of the first pivotal portions 12 of the base 1. Each side 31 of the connecting frame 3 further includes a third pivotal portion 34 and a fourth pivotal portion 35 below the third pivotal portion 34. The lower portion 32 of the connecting frame 3 includes a lower pivotal portion 36. In this embodiment, the sides 31 of the connecting frame 3 are two arms extending from two ends of the lower portion 32 of the connecting frame 3.

The seat 4 includes two sides. Each side of the seat 4 includes a rear end having a fifth pivotal portion 41 pivotably connected to the third pivotal portion 34 of one of the sides 31 of the connecting frame 3. Each side of the seat 4 further includes a sixth pivotal portion 42 located in front of the fifth pivotal portion 41. Each side of the seat 4 further includes a front end having a front pivotal portion 43. Each side of the seat 4 further includes a coupling member 44 behind the sixth pivotal portion 42.

The operative frame 5 includes a rear end pivotably connected to the connecting frame 3 and a front end coupled to the guiding rod 13 of the base 1. Specifically, the operative frame 5 includes two sides 51. Each side 51 of the operative frame 5 includes a rear end having a seventh pivotal portion 53 pivotably connected to the fourth pivotal portion 35 of one of the sides 31 of the connecting frame 3. An eighth pivotal portion 54 and a sliding sleeve 55 are provided on a front end of each side 51 of the operative member 5. Each sliding sleeve 55 is mounted around one of the guiding rods 13 of the base 1. In this embodiment, the operative frame 5 includes a connecting rod 52 extending between an intermediate portion of one of the sides 51 of the operative frame 5 and an intermediate portion of the other side 51 of the operative frame 5.

Each supporting plate 6 is pivotably connected to the front end of the operative frame 5 and the front end of the seat 4. Specifically, each supporting plate 6 includes a first end having a ninth pivotal portion 61 and a second end having a tenth pivotal portion 62. The ninth pivotal portion 61 of each supporting plate 6 is pivotably connected to the eighth pivotal portion 54 of one of the sides 51 of the operative member 5. The tenth pivotal portion 62 of each supporting plate 6 is pivotably connected to the sixth pivotal portion 42 of one of the sides of the seat 4.

The legrest 7 is mounted to the front ends of the sides of the seat 4. The legrest 7 includes a side having a rear pivotal portion 72 pivotably connected to the front pivotal portion 43 of the seat 4. The legrest 7 further includes an eleventh pivotal portion 73. The link 71 includes a rear end pivotably connected to the lower pivotal portion 36 of the connecting frame 3 and a front end pivotably connected to the eleventh pivotal portion 73 of the legrest 7.

Each elastic element 8 is attached between the coupling member 44 of one of the sides of the seat 4 and the ninth pivotal portion 61 of one of the supporting plates 6.

After assembly of the first embodiment, when the chair is in a substantially upright position shown in FIGS. 2 and 3, each sliding sleeve 55 is located on a rear end of a corresponding guiding rod 13 when the backrest 2 is not moved backward, and each supporting plate 6 is not in an extended position.

Figure 4:
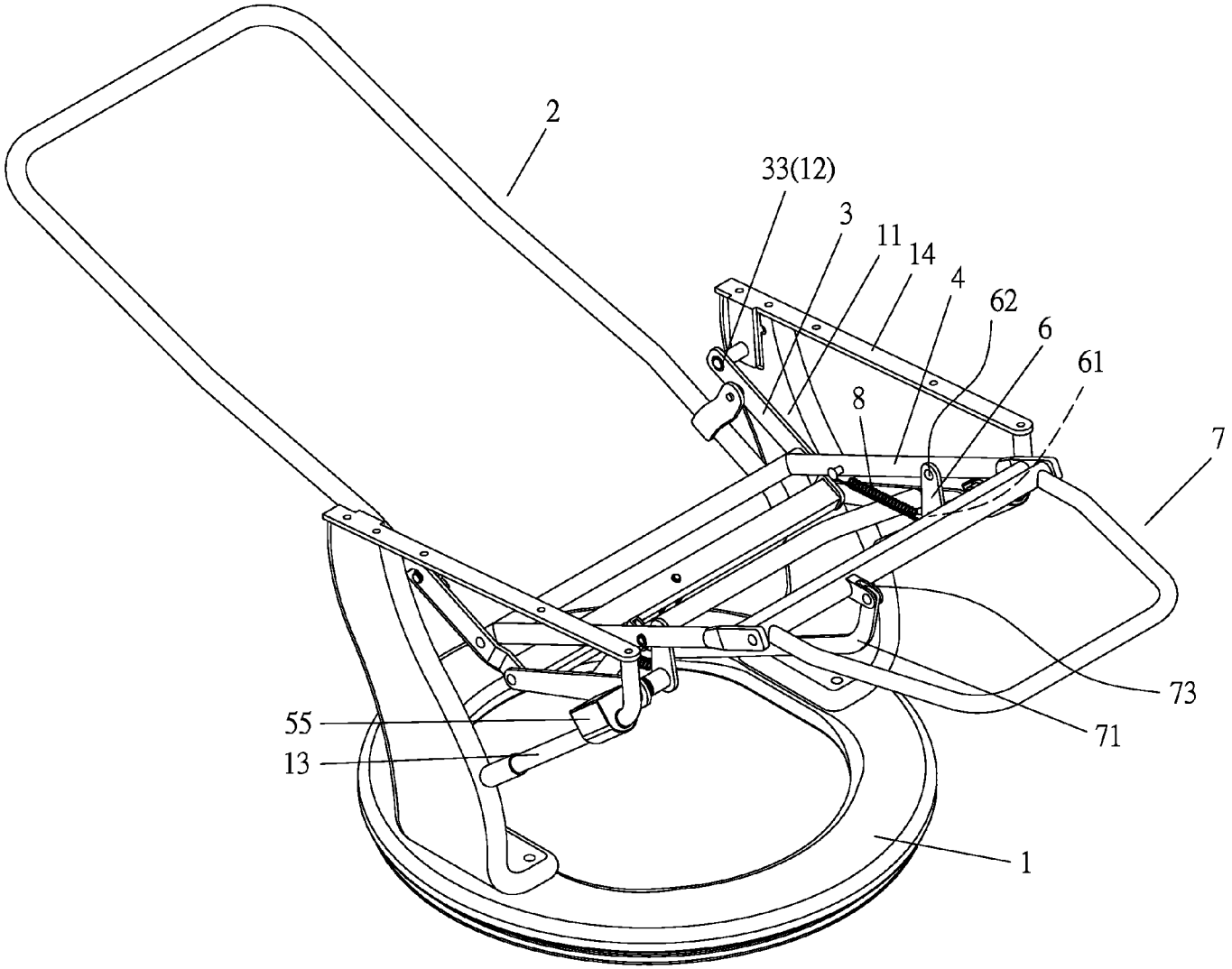
FIG. 4 is another perspective view of the chair in a reclining position.
Figure 5:
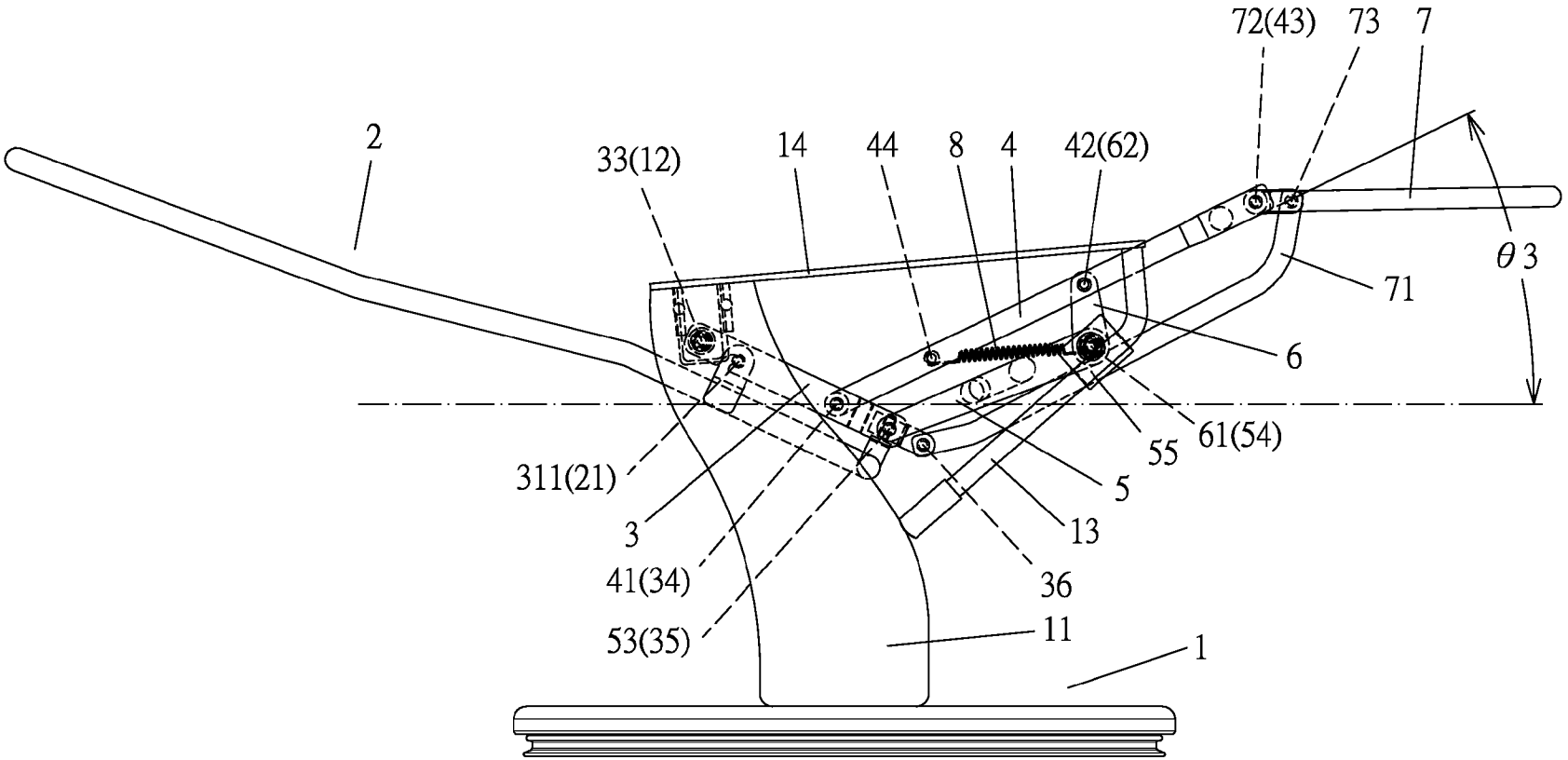
FIG. 5 is a side view of the chair of FIG. 4, with the chair in the reclining position.

With reference to FIGS. 4 and 5, when the backrest 2 is moved backward, the connecting frame 3 is actuated to pivot about the first pivotal portion 12 of the base 1. Furthermore, the connecting frame 3 actuates the operative frame 5 and the seat 4 to move forward, moving each sliding sleeve 55 to a front end of the corresponding guiding rod 13. Since the front end of each guiding rod 13 is fixed to one of the armrests 14, forward movement of each sliding sleeve 55 is retrained. Furthermore, forward movement of the operative frame 5 moves the supporting plates 6 to a vertical position (the extended position), and the front end of the seat 4 is moved upward by the supporting plates 6 in the extended position. Thus, an angle $\theta 3$ between the seat 4 and the horizontal direction is larger than that of the chair in the substantially upright position. Further, the connecting frame 3 actuates the link 71 and the legrest 7 to an extended position. Thus, most weight of a body of a user lying in the chair is imparted to the backrest 2 when the seat 4 is in the reclining position, providing enhanced lying comfort. Further, when the backrest 2 moves backward, the seat 4 moves not only upward but forward. Thus, the weight is evenly imparted to the front end and the rear end of the base 1 without the risk of falling, providing enhanced supporting reliability and enhanced safety.

Thus, when the seat 4 moves upward, the supporting plates 6 cooperate with the sliding sleeves 55 and the guiding rods 13 to support the front end of the seat 4, providing enhanced supporting reliability. Furthermore, when the backrest 2 moves backward, the elastic elements 8 are stretched while the operative frame 5 moves forward, buffering the backward force of the backrest 2 to provide smooth operation and safety. The elastic elements 8 can return the backrest 2 to the substantially upright position.

Figure 6:
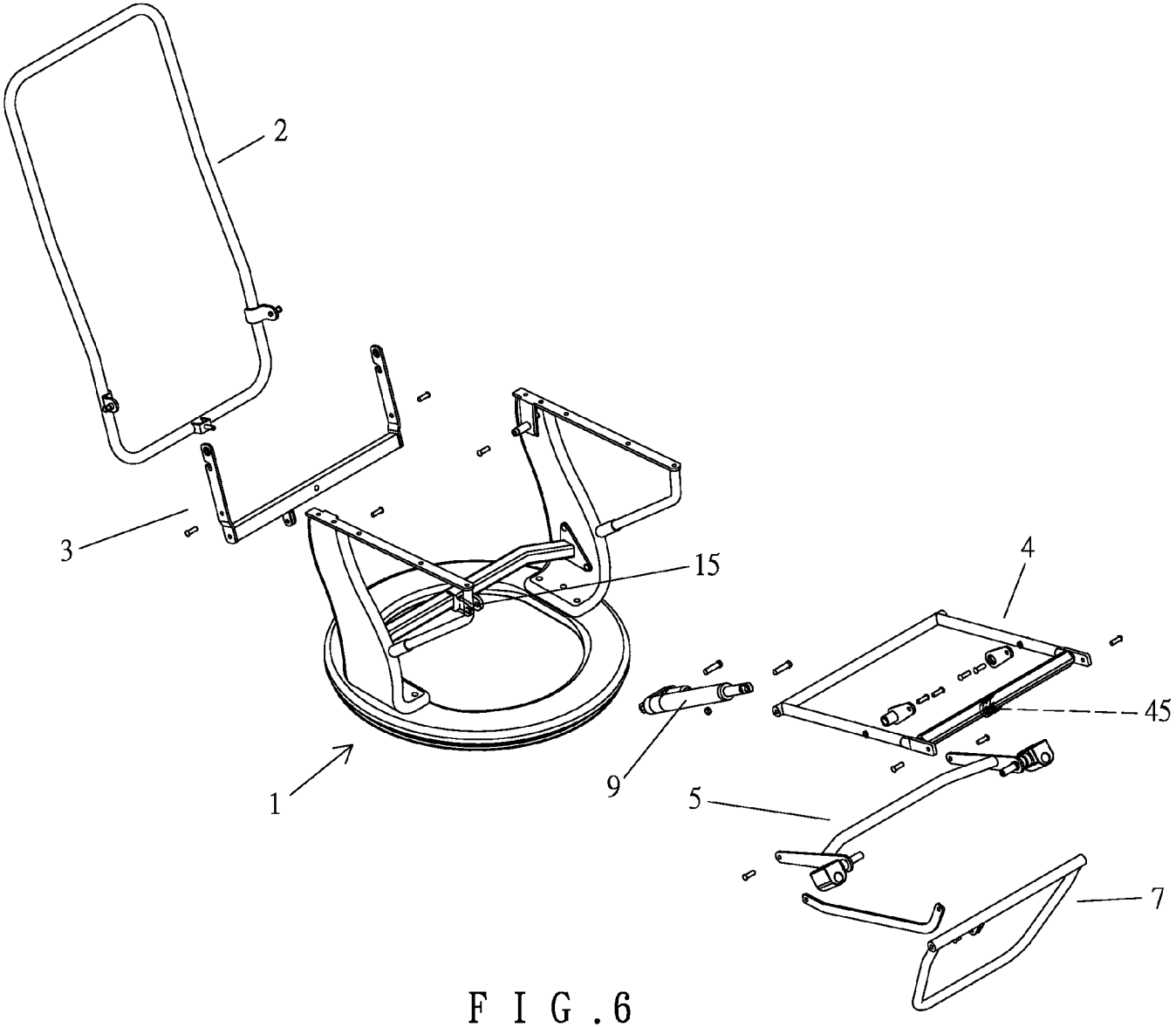
FIG. 6 is an exploded, perspective view of a chair of a second example according to the present invention.
Figure 7:
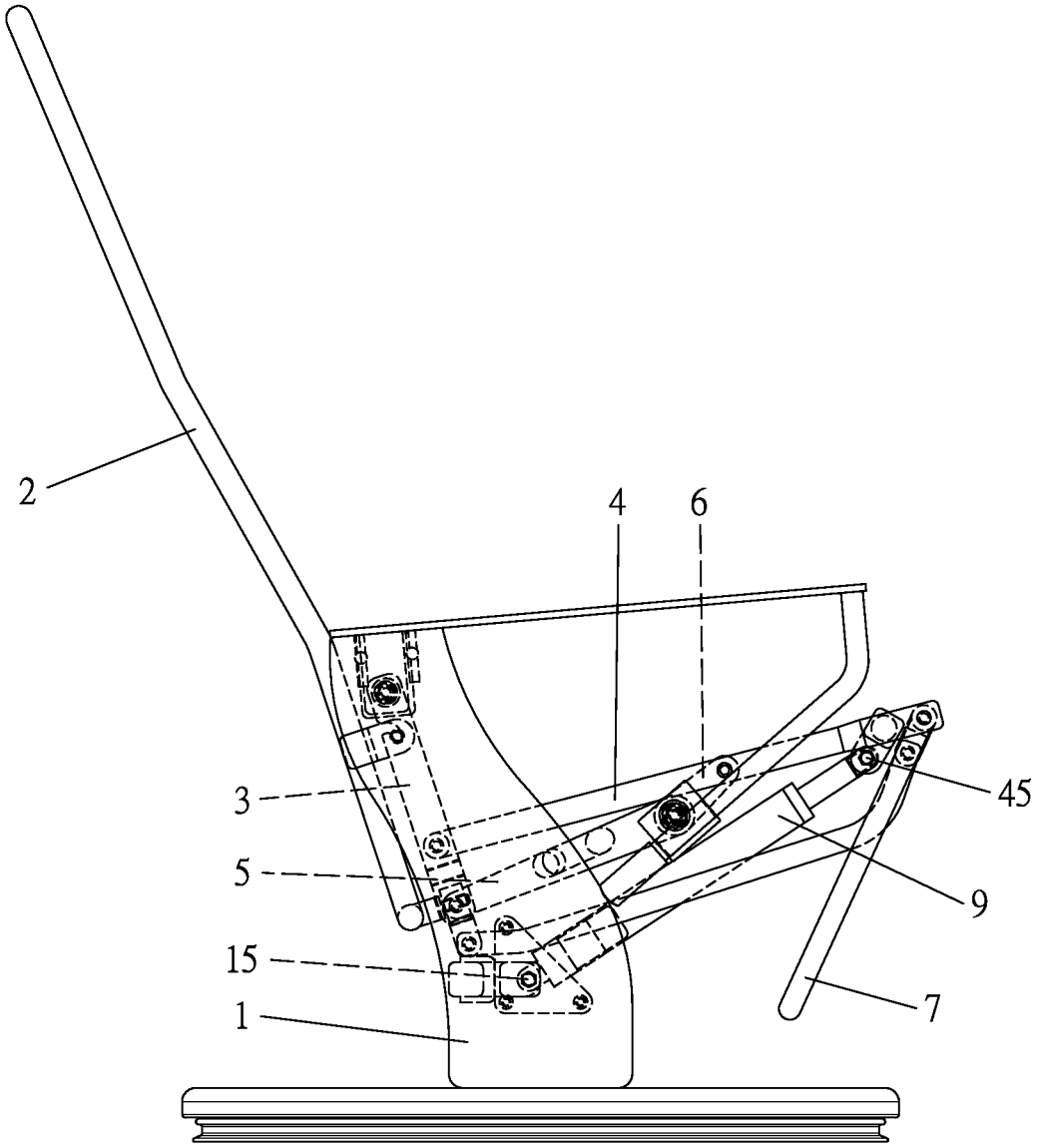
FIG. 7 is a side view of the chair of FIG. 6, with the chair in a substantially upright position.
Figure 8:
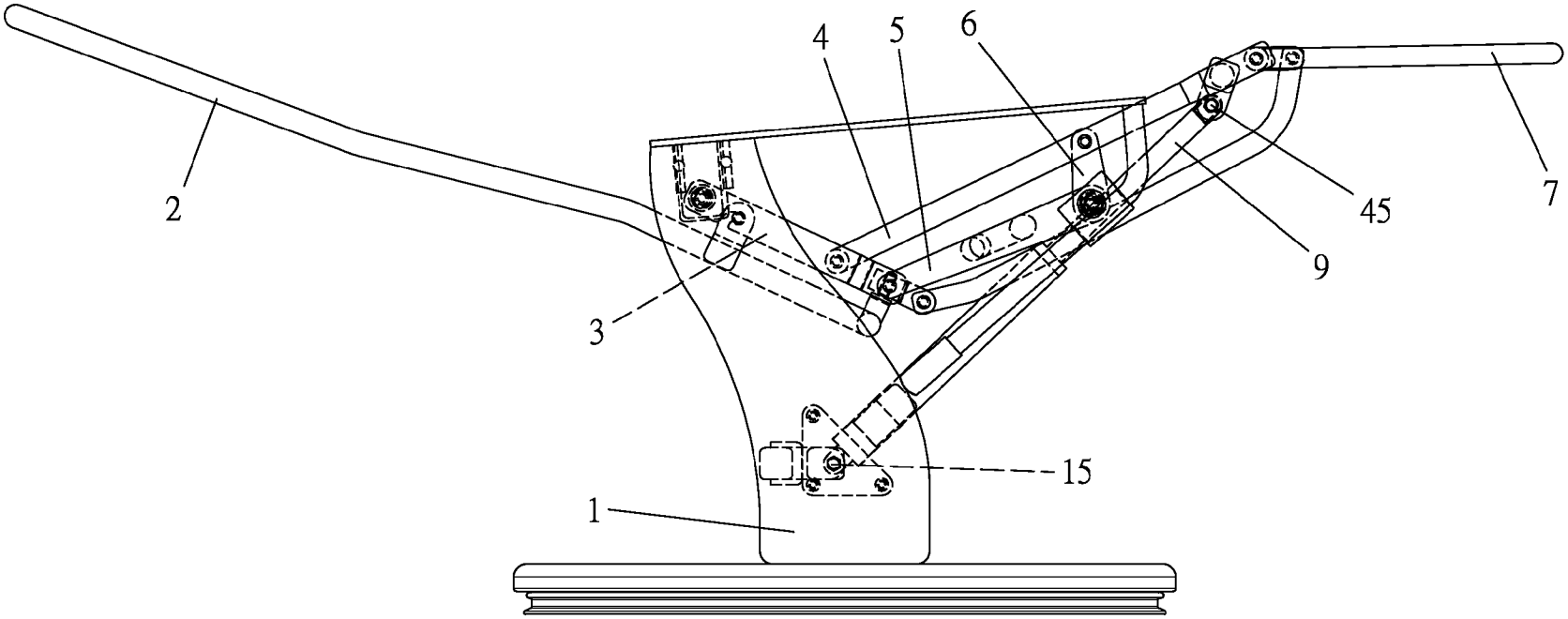
FIG. 8 is a side view of the chair of FIG. 6, with the chair in a reclining position.
Figure 9:
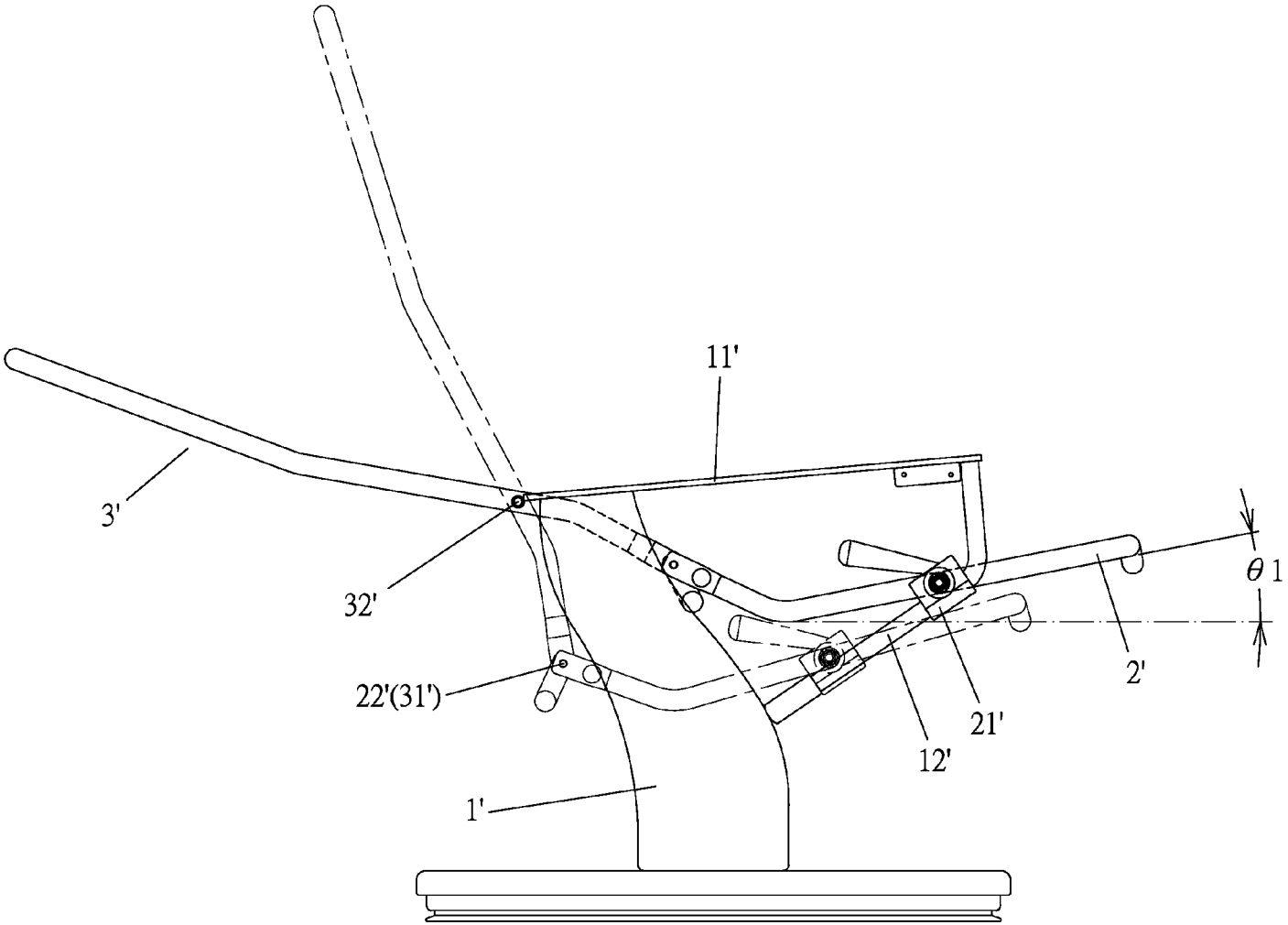
PRIOR ART FIG.9
FIG. 9 is a side view of a conventional chair.
Figure 10:
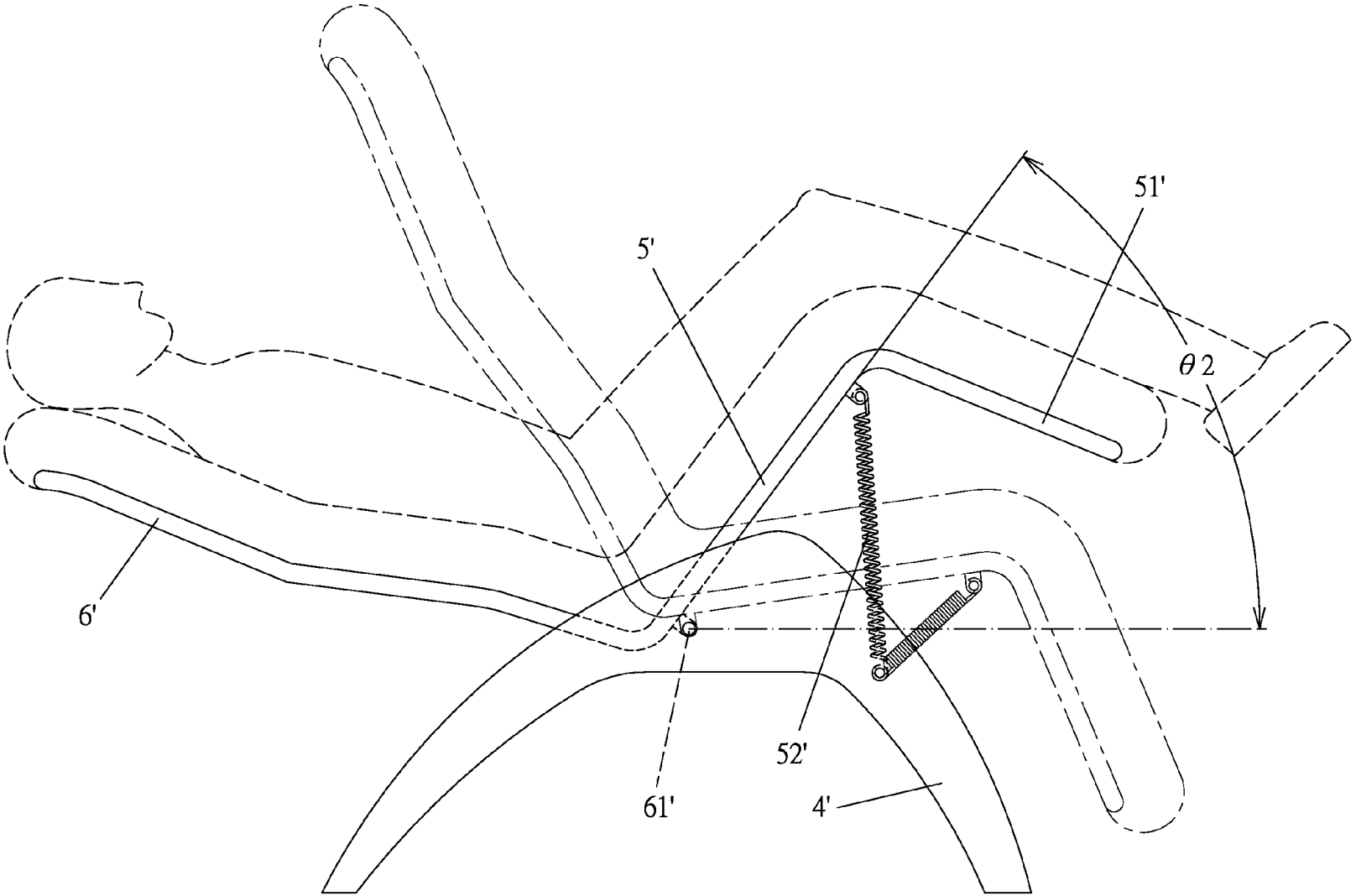
PRIOR ART FIG. 10
FIG. 10 is a side view of another conventional chair.

FIGS. 6 and 7 show a chair of a second example according to the present invention substantially the same as the first example. The differences between the second example and the first example are that the second example includes a telescopic rod 9 and does not include the elastic elements 8. The base 1 includes a lower portion having a twelfth pivotal portion 15 pivotably connected to a first end of the telescopic rod 9. The front end of the seat 4 includes a fourteenth pivotal portion 45 pivotably connected to a second end of the telescopic rod 9. The telescopic rod 9 can be driven by a motor. When the telescopic rod 9 is in a retracted position, the backrest 2 is in the substantially upright position. With reference to FIG. 8, when the telescopic rod 9 is moved to an extended position, the seat 4 is moved forward to actuate the operative frame 5 forward, moving the supporting plates 6 to the extended position, moving the backrest 2 backward, and extending the legrest 7, providing lying comfort, a balanced center of gravity, and safety. The telescopic rod 9 can be actuated to move the backrest 2 backward to the reclining position or forward to the substantially upright position, providing operational convenience.

In view of the foregoing, since backward movement of the backrest 2 provides an almost weightless pivoting function to provide comfort lying, most weight of the user lying in the chair is imparted to the backrest 2. Furthermore, the seat 2 moves forward and upward to provide stable operation and a stable center of gravity.

The chair according to the present invention does not have to include the legrest 7. Further, each sliding sleeve 55 can include a locking device to lock on the corresponding guiding rod 13 for better positioning.

Although specific embodiments have been illustrated and described, numerous modifications and variations are still possible without departing from the scope of the invention. The scope of the invention is limited by the accompanying claims.

The invention claimed is:

1. A chair comprising:

a base including a first pivotal portion on an upper portion thereof, with the base further including a guiding rod in front of the first pivotal portion;

a backrest;

a connecting frame mounted to the backrest, with the connecting frame including a second pivotal portion pivotably connected to the first pivotal portion of the base;

a seat including a rear end pivotably connected to the connecting frame and a front end;

an operative frame including a rear end pivotably connected to the connecting frame and a front end, with a sliding sleeve mounted on the front end of the operative frame and mounted around the guiding rod;

at least one supporting plate including a first end pivotably connected to the front end of the operative frame and a second end pivotably connected to the front end of the seat, wherein when the backrest is not moved backward, the sliding sleeve is located on a rear end of the guiding rod, and the at least one supporting plate is not in an extended position, and wherein when the backrest is moved backward, the connecting frame is actuated to move the operative frame and the seat forward, the at least one supporting plate is moved to the extended position, and the front end of the seat is moved upward by the at least one supporting plate in the extended position.

2. The chair as claimed in claim 1, with the base including left and right sides, with a column extending upright from each of the left and right sides of the base, with the first pivotal portion and the guiding rod provided on each column of the base, with the guiding rod located below the first pivotal portion, with the connecting frame including two sides, with each of the two sides of the connecting frame including a third pivotal portion and a fourth pivotal portion below the third pivotal portion, with the seat including two sides, with each of the two sides of the seat including a rear end having a fifth pivotal portion pivotably connected to the third pivotal portion of one of the two sides of the connecting frame, with each of the two sides of the seat further including a sixth pivotal portion located in front of the fifth pivotal portion, with the operative frame including two sides, with each of the two sides of the operative frame including a rear end having a seventh pivotal portion pivotably connected to the fourth pivotal portion of one of the two sides of the connecting frame, with each of the two sides of the operative member further including a front end having an eighth pivotal portion and the sliding sleeve, with the at least one supporting plate including two supporting plates, with each of the two supporting plates including a first end having a ninth pivotal portion and a second end having a tenth pivotal portion, with the ninth pivotal portion of each of the two supporting plates pivotably connected to the eighth pivotal portion of one of the two sides of the operative member, with the tenth pivotal portion of each of the two supporting plates pivotably connected to the sixth pivotal portion of one of the two sides of the seat.

3. The chair as claimed in claim 2, further comprising: a legrest and a link, with the connecting frame further including a lower pivotal portion, with each of the two sides of the seat further including a front end having a front pivotal portion, with the legrest mounted to the front ends of the two sides of the seat, with the legrest including a side having a rear pivotal portion, with the rear pivotal portion pivotably connected to the front pivotal portion of the seat, with the legrest further including an eleventh pivotal portion, with the link including a rear end pivotably connected to the lower pivotal portion of the connecting frame and a front end pivotably connected to the eleventh pivotal portion of the legrest.

4. The chair as claimed in claim 2, further comprising: two elastic elements, with each of the two sides of the seat including a coupling member behind the sixth pivotal portion, with each of the two elastic elements attached between the coupling member of one of the two sides of the seat and the ninth pivotal portion of one of the two supporting plates.

5. The chair as claimed in claim 3, further comprising: a telescopic rod including first and second ends, with the base including a lower portion having a twelfth pivotal portion pivotably connected to the first end of the telescopic rod, with the front end of the seat including a fourteenth pivotal portion pivotably connected to the second end of the telescopic rod.

6. The chair as claimed in claim 2, with the backrest including a first peg on each of two sides thereof and a second peg on a lower end thereof, with each of the two sides of the connecting frame including a first peg hole pivotably receiving one of the first pegs of the backrest, with the connecting frame mounted in front of the lower end of the backrest, with the connecting frame further including a lower portion having a second peg hole pivotably receiving the second peg of the backrest.

7. The chair as claimed in claim 6, with the lower portion of the connecting frame including the lower pivotal portion, with the two sides of the connecting frame being two aims extending from two ends of the lower portion of the connecting frame.

8. The chair as claimed in claim 2, with the operative frame including a connecting rod extending between an intermediate portion of one of the two sides of the operative frame and an intermediate portion of another of the two sides of the operative frame.

* * * * *